US006491807B2

(12) United States Patent
Kimizuka et al.

(10) Patent No.: US 6,491,807 B2
(45) Date of Patent: Dec. 10, 2002

(54) PROCESS FOR PRODUCING SODIUM PERSULFATE

(75) Inventors: Kenichi Kimizuka, Kanagawa-ken (JP); Shoichiro Kajiwara, Kanagawa-ken (JP); Naoki Kogure, Kanagawa-ken (JP); Takamitsu Tsuruga, Kanagawa-ken (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 91 days.

(21) Appl. No.: 09/789,756

(22) Filed: Feb. 22, 2001

(65) Prior Publication Data

US 2001/0015322 A1 Aug. 23, 2001

(30) Foreign Application Priority Data

Feb. 23, 2000 (JP) ..... 2000-045978

(51) Int. Cl.[7] ..... C25D 9/00; C25B 1/00; C25B 1/28

(52) U.S. Cl. ..... 205/349; 205/496; 205/554; 205/471

(58) Field of Search ..... 205/349, 496, 205/554, 971

(56) References Cited

U.S. PATENT DOCUMENTS

| | | | | |
|---|---|---|---|---|
| 3,954,952 A | | 5/1976 | Hall et al. | |
| 4,144,144 A | | 3/1979 | Radimer et al. | |
| 5,958,208 A | * | 9/1999 | Thiele et al. | 205/471 |
| 6,200,454 B1 | | 3/2001 | Kimizuka et al. | |
| 6,214,197 B1 | | 4/2001 | Kimizuka et al. | |

* cited by examiner

*Primary Examiner*—Donald R. Valentine
(74) *Attorney, Agent, or Firm*—Antonelli, Terry, Stout & Kraus, LLP

(57) ABSTRACT

An electrolytic production of sodium persulfate in a decreased number of steps with low unit power cost is described. Sodium persulfate is caused to crystallize by the reaction between an anode product and sodium hydroxide. The resulting sodium persulfate slurry is separated into a mother liquor and sodium persulfate crystals which are recovered and dried to obtain product sodium persulfate. In the process of the invention, ammonia liberated in the reaction-type crystallization of sodium persulfate is recovered into a cathode product, which is then neutralized by sodium hydroxide and/or ammonia. The neutralized solution is combined with sodium sulfate recovered from the mother liquor after recovering the sodium persulfate crystals and reused as a part of the starting material for an anolyte feed solution.

9 Claims, No Drawings

PROCESS FOR PRODUCING SODIUM PERSULFATE

BACKGROUND OF THE INVENTION

1. Field of the Invention

The present invention relates to a process for producing sodium persulfate. Sodium persulfate has been widely used in industrial process, for example, as a polymerization initiator for the production of polyvinyl chloride and polyacrylonitrile and as a treating agent for printed wiring boards.

2. Description of the Prior Art

As a general production method of sodium persulfate, the reaction between ammonium persulfate and sodium hydroxide in an aqueous solution has been known (U.S. Pat. No. 3,954,952). However, this process is uneconomical because the yield of sodium persulfate based on ammonium persulfate is low due to a large number of steps required. In addition, the concentration of sulfuric acid in the catholyte feed solution should be lowered to maintain a high solubility of ammonium sulfate to the catholyte feed solution, this increasing the electrolytic voltage, i.e., the unit power cost.

U.S. Pat. No. 4,144,144 discloses a direct electrolytic production of sodium persulfate using a neutral anolyte feed solution in the presence of ammonium ion. In this process, the mother liquor after removing crystallized sodium persulfate is mixed with a cathode product and recycled to an electrolytic step as the anolyte feed solution. Therefore, the electrolysis is conducted in the presence of sodium persulfate which participates nothing in the electrolysis, this increasing the electrolysis voltage and decreasing the current efficiency. In addition, since the resultant sodium persulfate crystals contain nitrogen in higher concentrations, a careful and thorough washing is necessary to purify sodium persulfate to an acceptable level for practical use.

SUMMARY OF THE INVENTION

An object of the present invention is to solve the above problems in the prior art and to provide a process for producing sodium persulfate in a low unit power cost and a reduced number of production steps.

After extensive study for solving the above problems, the inventors have found that sodium persulfate is more economically produced by electrolyzing an anolyte feed solution containing sodium sulfate, ammonium sulfate and sodium persulfate, reacting the resulting anode product with sodium hydroxide and crystallizing sodium persulfate by concentration, while recovering ammonia gas liberated from the crystallization step into a cathode product, followed by neutralizing the resulting cathode product with sodium hydroxide and/or ammonia and recycling a mixture of the neutralized solution with sodium sulfate recovered from a crystallization mother liquor as a part of the starting material for the anolyte feed solution.

Thus, the present invention provides a process for producing sodium persulfate, comprising (1) a step of electrolyzing a catholyte feed solution containing sulfuric acid and an anolyte feed solution containing sodium sulfate, ammonium sulfate and sodium persulfate, thereby obtaining a cathode product and an anode product; (2) a step of reacting the anode product with sodium hydroxide in a reaction-type crystallizer, thereby obtaining a reaction mixture; (3) a step of crystallizing sodium persulfate from the reaction mixture by concentration, thereby obtaining a sodium persulfate slurry; (4) a step of separating the sodium persulfate slurry to sodium persulfate crystals and a mother liquor, thereby recovering the sodium persulfate crystals; (5) a step of crystallizing sodium sulfate from the mother liquor, thereby obtaining a sodium sulfate slurry; (6) a step of separating sodium sulfate crystals from the sodium sulfate slurry; (7) a step of recovering ammonia gas liberated in the step (2) into the cathode product obtained in the step (1); (8) a step of neutralizing the resulting cathode product with sodium hydroxide and/or ammonia to obtain a neutralized cathode product; and (9) a step of recycling the neutralized cathode product and the sodium sulfate separated in the step (6) to the step (1) as a part of a starting material for the anolyte feed solution.

DETAILED DESCRIPTION OF THE INVENTION

In the electrolysis step (1) of the process of the present invention, an aqueous solution containing, by weight, 5 to 18% sodium sulfate, 21 to 38% ammonium sulfate and 0.1 to 2% sodium persulfate is used as an anolyte feed solution. The sulfate ratio, sodium sulfate/ammonium sulfate, is preferably 0.1 to 0.9 by weight. When the sulfate ratio is less than 0.1, the available amount of sodium sulfate obtained in the separation step (6) is reduced to increase the unit material cost. A sulfate ratio higher than 0.9 increases the electrolytic voltage to increase the unit power cost. The anolyte feed solution may further contain 0.01 to 0.1% by weight of a known polarizer such as thiocyanate, cyanide, cyanate and fluoride. The catholyte feed solution is a 20 to 80% by weight aqueous solution of sulfuric acid.

The electrolytic cell usable in the present process is not specifically limited so long as it is structured to separate the anode from the cathode by a diaphragm, and a box electrolytic cell or a filter press electrolytic cell is preferably used. The diaphragm for the box electrolytic cell is made of an oxidation resistant material such as alumina. Ion-exchange membranes are preferably used as the diaphragm of the filter press electrolytic cell.

The anode is preferably made of platinum, although anodes made of a chemically resistant material such as carbon are usable. The cathode is preferably made of zirconium or lead, although cathodes made of a chemically resistant material such as stainless steel are usable. The anode current density is 40 to 120 $A/dm^2$, preferably 60 to 80 $A/dm^2$. A current density lower than 40 $A/dm^2$ produces a poor current efficiency. A current density higher than 120 $A/dm^2$ could be used, but uneconomical because a specific power supply equipment is needed due to a considerable heat generation at a bus bar.

The electrolytic cell is operated at 10 to 40° C., preferably 25 to 35° C. Temperatures lower than 10° C. are detrimentally low because sodium sulfate, etc. begin to crystallize to make the process inoperable and an unnecessarily high electrolytic voltage is required. Temperatures exceeding 40° C. are undesirably high because excessive decomposition of the resulting persulfate ion occurs to result in a low yield of sodium persulfate.

Then, the anode product from the electrolysis step (1) is introduced into a reaction-type crystallizer and reacted with an aqueous solution of sodium hydroxide in the step (2), followed by the step (3) where sodium persulfate is caused to crystallize from the reaction mixture by concentration. The reaction-type crystallizer is not specifically limited so long as it is operable under reduced pressure, and a reaction-type crystallizer equipped with an agitator, preferably a double propeller reaction-type crystallizer having a clarification zone is used. The reaction-type crystallizer so constructed facilitates the sampling of at least a part of the liquid therein in the step (3) for crystallizing sodium persulfate.

The crystallization of sodium persulfate in the reaction-type crystallizer is carried out at 15 to 60° C., preferably 20 to 50° C. When the temperature is lower than 15° C., the reaction rate between the anolyte product and sodium hydroxide is low and the coexisting sodium sulfate is likely to crystallize to lower the purity of sodium persulfate crystals. At temperatures higher than 60° C., excessive decomposition of the resulting sodium persulfate occurs to result in a low yield of sodium persulfate. The residence time in the reaction-type crystallizer depends on the desired particle size of sodium persulfate, and generally selected from the range of 1 to 10 hours. The residence time can be shorter than one hour if sodium persulfate with smaller particle size is desired.

Sodium hydroxide is added to the anode product solution introduced into the reaction-type crystallizer in an amount enough to displace at least proton and ammonium ion attributable to by-produced sulfuric acid, ammonium persulfate and ammonium sulfate present in the solution by sodium ion. Preferably, sodium hydroxide is added in an amount such that the liquid in the reaction-type crystallizer is adjusted to the pH range of 9 to 12. The rate of effusion of ammonia is low at a pH lower than 9 to increase the nitrogen content of the sodium persulfate crystals, and the persulfate ion is likely to decompose at a pH higher than 12 to reduce the yield of sodium persulfate. The pressure inside the reaction-type crystallizer is adjusted to a level which allows water to boil at the temperature range mentioned above. The liberated ammonia gas is recovered into the cathode product obtained in the electrolysis step (1), as described below.

The sodium persulfate slurry obtained in the crystallization step (3) is separated into sodium persulfate crystals and a mother liquor in the separation step (4) using a solid-liquid separator such as a centrifuging separator. The separated crystals are dried to the final product by a powder drier. The reaction step (2) and the crystallization step (3) may be operated in the same reaction-type crystallizer having a clarification zone.

The mother liquor is transferred into the reaction-type crystallizer of the step (2) or into the crystallization step (5) of sodium sulfate. The crystallization of sodium sulfate is preferably conducted by a cooling crystallization method where sodium sulfate precipitates as a hydrate in the step (5) and separated from the sodium sulfate slurry in the step (6), for example, by a common technique such as centrifuging separation. The mother liquid after separating the crystallized sodium sulfate is returned to the reaction-type crystallizer of the step (2). If the separation of sodium sulfate is omitted, sodium sulfate formed by the reaction with sodium hydroxide added in the step (2) will build up in the reaction-type crystallizer, and ultimately coprecipitate with sodium persulfate to reduce the purity of the sodium persulfate product. The crystallization of sodium sulfate is conducted in a cooling crystallizer equipped with a cooling means. If a double propeller crystallizer having a clarification zone is used in the step (2), the clarified liquid is treated to separate sodium sulfate.

Sodium sulfate is separated in an amount such that the concentration of sodium sulfate in the reaction-type crystallizer of the step (2) is maintained constant. Namely, sodium sulfate is removed in an amount corresponding to the total amount of the sulfate ion contained in the anode product to be fed into the reaction-type crystallization steps (2) and (3) and the sulfate ion formed during the operation of the reaction-type crystallization by the decomposition of persulfate ion. Namely, the amount of sodium sulfate to be removed can be determined by the total amount of the sulfate ion in the anode product measured by a common method such as titration and the amount of decomposed persulfate ion obtained from the material balance of the reaction-type crystallization steps (2) and (3). By regulating the feeding rate of the mother liquor to the cooling crystallizer so that sodium sulfate crystallizes in the determined amount, the desired amount of sodium sulfate can be precipitated and removed. The recovered hydrate of sodium sulfate is recycled as a part of the starting material for the anolyte feed solution as described below.

As described above, the precipitating amount of sodium sulfate depends on the feeding rate and the chemical composition of the starting solution to be fed into the cooling crystallizer. For example, in the cooling crystallization of a 30° C. saturated solution containing, by weight, 35% sodium persulfate and 8% sodium sulfate at 18° C., sodium sulfate decahydrate precipitates in an amount of about 8% by weight based on the starting saturated solution.

The cooling crystallization of the step (5) is conducted at 5 to 30° C., preferably 15 to 25° C. Sodium sulfate precipitate insufficiently at temperatures higher than 30° C. to reduce the purity of the sodium persulfate product. Sodium persulfate coprecipitate with sodium sulfate at temperatures lower than 5° C. to increase the content of sodium persulfate in sodium sulfate.

In the step (7), ammonia gas liberated from the reaction-type crystallizer of the step (2) is recovered into the cathode product obtained in the step (1), as described above. Sulfuric acid remaining in the cathode product after absorbing ammonia is neutralized with sodium sulfate and/or ammonia gas in the step (8). Then, sodium sulfate recovered in the step (6) and a desired amount of the polarizer are dissolved into the resulting neutralized solution in the step (9). The solution thus obtained is recycled as a starting material for the anolyte feed solution. To maintain the dissolution of sodium sulfate and the polarizer, the solution may be diluted with water.

In the continuous process of the present invention, the neutralization by sodium hydroxide is switched to the neutralization by ammonia gas and vice versa such that the sulfate ratio, sodium sulfate/ammonium sulfate, in the anolyte feed solution is regulated within the range of 0.1 to 0.9 by weight. Since ammonia and sodium sulfate are circulated in the present process, the amount of ammonia gas used in the neutralization corresponds to the loss of the ammonia in the recovery step (7).

A part of the anode product obtained in the electrolysis step (1) may be concentrated prior to the reaction with sodium hydroxide in the step (2) to increase the reaction rate between the anode product and sodium hydroxide in the reaction step (2). The degree of concentration can be increased by concentrating after mixing the anode product solution with the mother liquor after recovering sodium sulfate in the step (6). Since the mother liquor is a saturated solution at an operating. temperature (5 to 30° C.) of the step (5), the degree of concentration can be increased as compared with when concentrating the as-obtained anode product solution.

The present invention will be explained in more detail by reference to the following examples which should not be construed to limit the scope of the present invention. The current efficiency in the examples is the amount of formed persulfate ion per unit quantity of current transferred in the electrolysis, and expressed by the equation: formed persulfate ion (mol)×2)/(transferred quantity of current (F)×100 (%). The average electrolytic voltage is a potential difference between the cathode and the anode, and the concentration is expressed by weight.

EXAMPLE 1

An electrolytic cell made of a transparent polyvinyl chloride was used. The anode compartment and the cathode compartment were separated from each other by a diaphragm made of a porous neutral alumina which was fixed in place by a silicone rubber caulking compound. Each compartment was provided with a buffer tank also serving as a cooling tank. Each electrolytic solution of an anolyte solution and a catholyte solution was fed into an electrolytic chamber from the buffer tank and the electrolytic solution was allowed to return to the buffer tank through an electrolytic chamber outlet by overflowing. The buffer tank was provided with a cooling tube, through which a cooling water was circulated. A platinum anode and a lead plate cathode were used. The anode and the cathode were positioned on opposite sides of the diaphragm and about 0.5 cm apart from the diaphragm. Direct current for electrolysis was obtained from a variable rectifier.

An anolyte feed solution (130 kg) initially containing 14.2% sodium sulfate, 25.3% ammonium sulfate, 0.5% sodium persulfate and 0.03% ammonium thiocyanate, and a catholyte feed solution (70 kg) initially containing 52.0% sulfuric acid were used. The electrolysis was continued for 10 hours at an anode current density of 72 A/dm$^2$ The quantity of current transferred in the electrolysis was 470 F.

After the electrolysis, 114 kg of an anode product and 86 kg of a cathode product were obtained. The chemical compositions determined by the titration were 26.8% ammonium persulfate, 12.7% sodium persulfate, 4.0% sodium sulfate and 3.0% sulfuric acid with no ammonium sulfate for the anode product, and 6.6% sodium sulfate, 17.7% ammonium sulfate and 16.8% sulfuric acid for the cathode product. The current efficiency was 82.0%, the average electrolytic voltage was 6.6 V, the average anolyte solution temperature was 28.7° C., and the average catholyte solution temperature was 29.2° C.

The anode product (114 kg) thus obtained was mixed with a mother liquor (246 kg) after sodium sulfate removal, which had been pre-prepared through the steps (1) to (6). The mixed solution was fed into a continuous distillation apparatus equipped with an agitator and a condenser at a feeding rate of 72.0 kg/hr, and subjected to a primary concentration at 45° C. under 9580 Pa by evaporating water at a speed of 6.8 kg/hr, thereby obtaining a concentrate at a speed of 65.2 kg/hr. The as-obtained concentrate was fed into a reaction-type crystallizer mentioned below, to which a 48% aqueous solution of sodium hydroxide was further fed at a feeding rate of 5.7 kg/hr.

A double propeller crystallizer was used as the reaction-type crystallizer for crystallizing sodium persulfate, and an apparatus for crystallizing and recovering sodium sulfate was disposed in a circulating line for a clarified liquid. Into the reaction-type crystallizer, 96 kg of a 30° C. saturated solution containing 35% sodium persulfate and 8% sodium sulfate, which had been prepared through the steps (1) to (6) of electrolysis step, crystallization step of sodium persulfate and removal step of sodium sulfate, and 24 kg of sodium persulfate seed were added in advance.

Then, the mixture in the reaction-type crystallizer was subject to a secondary concentration at 30° C. under a vacuum degree of 2600 Pa to crystallize sodium persulfate. A slurry taken out of the bottom of the reaction-type crystallizer was separated into crystals and a mother liquor by a centrifuging filter. The mother liquor was returned to the reaction-type crystallizer, and the crystals were dried to obtain a product sodium persulfate. The evaporation speed of water was 7.2 kg/hr and the production speed of sodium persulfate (dry basis) was 8.7 kg/hr. The liberated ammonia accompanying the concentration was recovered into the cathode product. The above operations were continued over 5 hours.

The dried crystals obtained above weighed 46.2 kg in total, and the purity thereof was 99.8%. The yielded amount of sodium persulfate crystals was equivalent to the amount of persulfate ion formed by the electrolysis. The nitrogen content of the crystals was 0.002%.

The clarified liquid in the double propeller reaction-type crystallizer was continuously drawn and fed into a cooling crystallizer, followed by crystallizing sodium sulfate decahydrate at 18° C. under ordinary pressure. A slurry from the bottom of the cooling crystallizer was separated into sodium sulfate crystals and a mother liquor which was returned to the reaction-type crystallizer of the step (2). The crystallization speed was 4.4 kg/hr and the operation was continued for 5 hours to obtain 22 kg of sodium sulfate decahydrate containing 3% sodium persulfate. By dissolving the crystals containing sodium persulfate to water, an aqueous solution containing 2% sodium persulfate and 28% sodium sulfate.

Ammonia liberated from the reaction-type crystallizer was recovered into the cathode product (86 kg) obtained in the previous electrolysis step (1), and the resulting solution was neutralized by 35 g of ammonia and 3.5 kg of a 48% aqueous solution of sodium hydroxide. The solution was further added with 39 g of ammonium thiocyanate and the solution of sodium sulfate prepared above to obtain 130 kg of a recycling anolyte feed solution.

The recycling anolyte feed solution was an aqueous solution containing 14.0% sodium sulfate, 25.1% ammonium sulfate, 0.5% sodium persulfate and 0.03% ammonium thiocyanate. The next run of electrolysis was conducted for 10 hours at an anode current density of 72 A/dm$^2$ using the recycling anolyte feed solution and a 52.0% aqueous solution of sulfuric acid as the catholyte feed solution. The transferred quantity of current was 470 F.

After the electrolysis, 114 kg of an anode product and 86 kg of a cathode product were obtained. In this electrolysis operation, the current efficiency was 82.0%, the average electrolytic voltage was 6.6 V, the average anolyte solution temperature was 30.3° C. and the average catholyte solution temperature was 31.5° C.

COMPARATIVE EXAMPLE 1

The direct electrolysis for producing sodium persulfate in the presence of ammonium ion, proposed by U.S. Pat. No. 4,144,144, was tested. The same apparatuses as the electrolytic cell, etc. used in Example 1 were used. The electrolysis was conducted at a current density of 72 A/dm$^2$ for 11.7 hours using an aqueous solution (132 kg) containing 20.6% sodium persulfate, 11.8% sodium sulfate, 10.0% ammonium sulfate and 0.03% ammonium thiocyanate with no sulfuric acid as the anolyte feed solution, and a 30.2% aqueous solution (37.1 kg) of sulfuric acid as the catholyte feed solution.

After the electrolysis, 128 kg of an anode product containing 35.0% sodium persulfate, 8.0% ammonium sulfate and 1.4% sulfuric acid with no sodium sulfate, and 44 kg of a cathode product containing 11.7% sodium sulfate, 6.8% ammonium sulfate and 12.1% sulfuric acid were obtained. In the electrolysis operation, the current efficiency was 80.0%, the average electrolytic voltage was 7.5 V, the average anolyte solution temperature was 33° C. and the average catholyte solution temperature was 38° C.

The acidic anode product containing sulfuric acid was neutralized by a 48% aqueous solution of sodium hydroxide to obtain 131 kg of a neutralized solution as a starting solution for crystallization. Into a crystallizer, added in advance were 96 kg of a 30° C. saturated solution containing 34.6% sodium persulfate, 3.3% sodium sulfate and 13.0% ammonium sulfate, which was separately prepared through the electrolysis step and the crystallization step. Further, 24 kg of sodium persulfate were added as the seed.

Then, the vacuum crystallization of sodium persulfate was conducted at 30° C. under a vacuum degree of 2660 Pa while feeding the starting solution to the crystallizer at a feeding rate of 22 kg/hr. The evaporation speed of water in the vacuum crystallization was 6 kg/hr. The crystallized sodium persulfate was separated and dried in the same manner as in Example 1 to obtain 17.8 kg of dried sodium persulfate crystals in a production speed of 3 kg/hr. The mother liquor was reused as a part of the anolyte solution. The sodium persulfate crystals thus obtained had a purity of 98.0% and a nitrogen content of 0.2%.

In this known production method, the current efficiency was about 80% which was about 2% lower than in the process of the present invention. The average electrolytic voltage was about 1 V which was higher than in the process of the present invention. In addition, the purity of the sodium persulfate crystals was low, and thorough washing with a saturated solution of sodium persulfate made slightly basic by sodium hydroxide was required to reach a purity as high as that attained in Example 1. However, the yield based on the sodium persulfate formed by the electrolysis was reduced to 95% due to thorough washing.

COMPARATIVE EXAMPLE 2

A general production method of sodium persulfate by the reaction of ammonium persulfate and sodium hydroxide was tested. The same apparatuses as the electrolytic cell, etc. used in Example 1 were used. The electrolysis was conducted at a current density of 72 A/dm$^2$ for 8.3 hours using an aqueous solution (182 kg) containing 7.2% ammonium persulfate, 33.7% ammonium sulfate, 5.8% sulfuric acid and 0.03% ammonium thiocyanate as the anolyte feed solution, and a 14.6% aqueous solution (153 kg) of sulfuric acid as the catholyte feed solution.

After the electrolysis, 172 kg of an anode product containing 35.4% sodium persulfate, 5.8% ammonium sulfate and 5.6% sulfuric acid, and 162 kg of a cathode product containing 14.7% ammonium sulfate and 1.79% sulfuric acid were obtained. In the electrolysis operation, the current efficiency was 81.0%, the average electrolytic voltage was 6.2 V, the average anolyte solution temperature was 27.3° C. and the average catholyte solution temperature was 28.2° C.

The anode product was maintained at 30° C. under 2660 Pa to cause ammonium persulfate to vacuum-crystallize to obtain a crystal slurry which was then separated into crystals and a mother liquor by a centrifuging separator. The separated wet crystals were re-dissolved into water and a 48% aqueous solution of sodium hydroxide was added. Sodium persulfate crystals were separated and recovered from the resulting slurry and thoroughly dried to obtain 47.4 kg sodium persulfate crystals having a purity of 99.5%. The yield of sodium persulfate was 95% based on ammonium persulfate in the anolyte solution.

The current efficiency and the average electrolytic voltage of this method were practically the same as those in the process of the present invention. However, the yield of sodium persulfate based on ammonium persulfate formed by the electrolysis was as extremely low as about 5%.

As described above, the present invention provides an economically advantageous method of producing sodium persulfate.

What is claimed is:

1. A process for producing sodium persulfate, comprising:

(1) a step of electrolyzing a catholyte feed solution containing sulfuric acid and an anolyte feed solution containing sodium sulfate, ammonium sulfate and sodium persulfate, thereby obtaining a cathode product and an anode product;

(2) a step of reacting the anode product with sodium hydroxide in a reaction-type crystallizer, thereby obtaining a reaction mixture and liberating ammonia gas;

(3) a step of crystallizing sodium persulfate from the reaction mixture by concentration, thereby obtaining a sodium persulfate slurry;

(4) a step of separating the sodium persulfate slurry to sodium persulfate crystals and a mother liquor, thereby recovering the sodium persulfate crystals;

(5) a step of crystallizing sodium sulfate from the mother liquor, thereby obtaining a sodium sulfate slurry;

(6) a step of separating sodium sulfate crystals from the sodium sulfate slurry;

(7) a step of recovering ammonia gas liberated in the step (2) into the cathode product obtained in the step (1);

(8) a step of neutralizing the resulting cathode product with sodium hydroxide and/or ammonia to obtain a neutralized cathode product; and (9) a step of recycling the neutralized cathode product and the sodium sulfates crystals separated in the step (6) to the step (1),as a part of a starting material for the anolyte feed solution.

2. The process according to claim 1, wherein the anolyte feed solution of the step (1) has a sodium sulfate/ammonium sulfate ratio of 0.1 to 0.9 by weight, and contains 0.1 to 2% by weight of sodium persulfate.

3. The process according to claim 2, wherein the anolyte feed solution contains 5 to 18% by weight of sodium sulfate and 21 to 38% by weight of ammonium sulfate.

4. The process according to claim 1, wherein the electrolysis of the step (1) is conducted at 10 to 40° C. and an anode current density of 40 to 120 A/dm$^2$.

5. The process according to claim 1, wherein the crystallization of sodium persulfate of the step (3) is conducted at 15 to 60° C. under a pressure which allows water to boil at a temperature range of 15 to 60° C.

6. The process according to claim 1, wherein sodium hydroxide is added in the step (2) in an amount such that a liquid in the reaction-type crystallizer is adjusted to a pH range of 9 to 12.

7. The process according to claim 1, wherein the steps (2) and (3) are conducted in the same reaction-type crystallizer having a clarification zone.

8. The process according to claim 1, wherein the crystallization of sodium sulfate in the step (5) is conducted at 5 to 30° C.

9. The process according to claim 1, wherein the neutralization of the step (8) is conducted so that a resulting neutralized solution has a sodium sulfate/ammonium sulfate ratio of 0.1 to 0.9 by weight.

* * * * *